US008302889B2

(12) United States Patent
Hashii et al.

(10) Patent No.: US 8,302,889 B2
(45) Date of Patent: Nov. 6, 2012

(54) FUEL INJECTION VALVE

(75) Inventors: Naoya Hashii, Chiyoda-ku (JP); Keishi Nakano, Chiyoda-ku (JP); Tsuyoshi Munezane, Chiyoda-ku (JP); Atsushi Yoshimura, Chiyoda-ku (JP); Manabu Miyaki, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/177,137

(22) Filed: Jul. 6, 2011

(65) Prior Publication Data

US 2011/0260084 A1 Oct. 27, 2011

Related U.S. Application Data

(62) Division of application No. 12/093,178, filed as application No. PCT/JP2007/056441 on Mar. 27, 2007, now Pat. No. 8,002,207.

(51) Int. Cl.
*B05B 1/00* (2006.01)

(52) U.S. Cl. ..... 239/596; 239/533.12; 239/585.1; 239/585.4; 239/900; 239/558

(58) Field of Classification Search ..... 239/596, 239/533.12, 585.1, 585.4, 900, 558
See application file for complete search history.

(56) References Cited

U.S. PATENT DOCUMENTS

| | | | | |
|---|---|---|---|---|
| 5,746,376 | A | 5/1998 | Romann et al. | |
| 5,862,991 | A * | 1/1999 | Willke et al. | 239/397.5 |
| 6,070,812 | A | 6/2000 | Tani et al. | |
| 6,837,449 | B2 | 1/2005 | Dantes et al. | |
| 7,048,202 | B2 | 5/2006 | Bierstaker et al. | |
| 7,150,417 | B2 | 12/2006 | Souma | |
| 8,096,490 | B2 * | 1/2012 | Yasukawa et al. | 239/533.12 |

FOREIGN PATENT DOCUMENTS

| | | | |
|---|---|---|---|
| EP | 2 108 811 | A1 | 10/2009 |
| JP | 09-014090 | A | 1/1997 |
| JP | 2001-027169 | A | 1/2001 |
| JP | 2002-004983 | A | 1/2002 |
| JP | 2006-207419 | A | 8/2006 |
| WO | 02/38946 | A1 | 5/2002 |
| WO | 2008/093387 | A1 | 8/2008 |

OTHER PUBLICATIONS

European Office Action for European Patent Application No. 07739879.0, dated Aug. 19, 2011.
Indian Office Action dated Apr. 30, 2012 for corresponding Indian Application No. 2176/CHENP/2008.

* cited by examiner

*Primary Examiner* — Dinh Q Nguyen
(74) *Attorney, Agent, or Firm* — Sughrue Mion, PLLC

(57) ABSTRACT

A fuel injection valve has a valve body for opening and closing a valve seat, and receives an operation signal from a control unit to operate the valve body so that fuel is injected from a plurality of injection holes formed in an injection hole plate welded through a welded portion to a downstream side of the valve seat while passing through a gap between the valve body and the valve seat. The injection hole plate is formed at its central portion with a convex portion which is substantially axisymmetric with respect to a valve seat axis and which has a circular-arc shaped cross section, and the welded portion is also substantially axisymmetric with respect to the valve seat axis. Inlet portions of the injection holes are disposed in an injection hole arrangement surface diametrically outside of the convex portion and diametrically inside of a valve seat opening inner wall which is a minimum inside diameter of the valve seat, and the injection hole arrangement surface is coplanar with a surface having the welded portion.

2 Claims, 13 Drawing Sheets

FIG. 3A
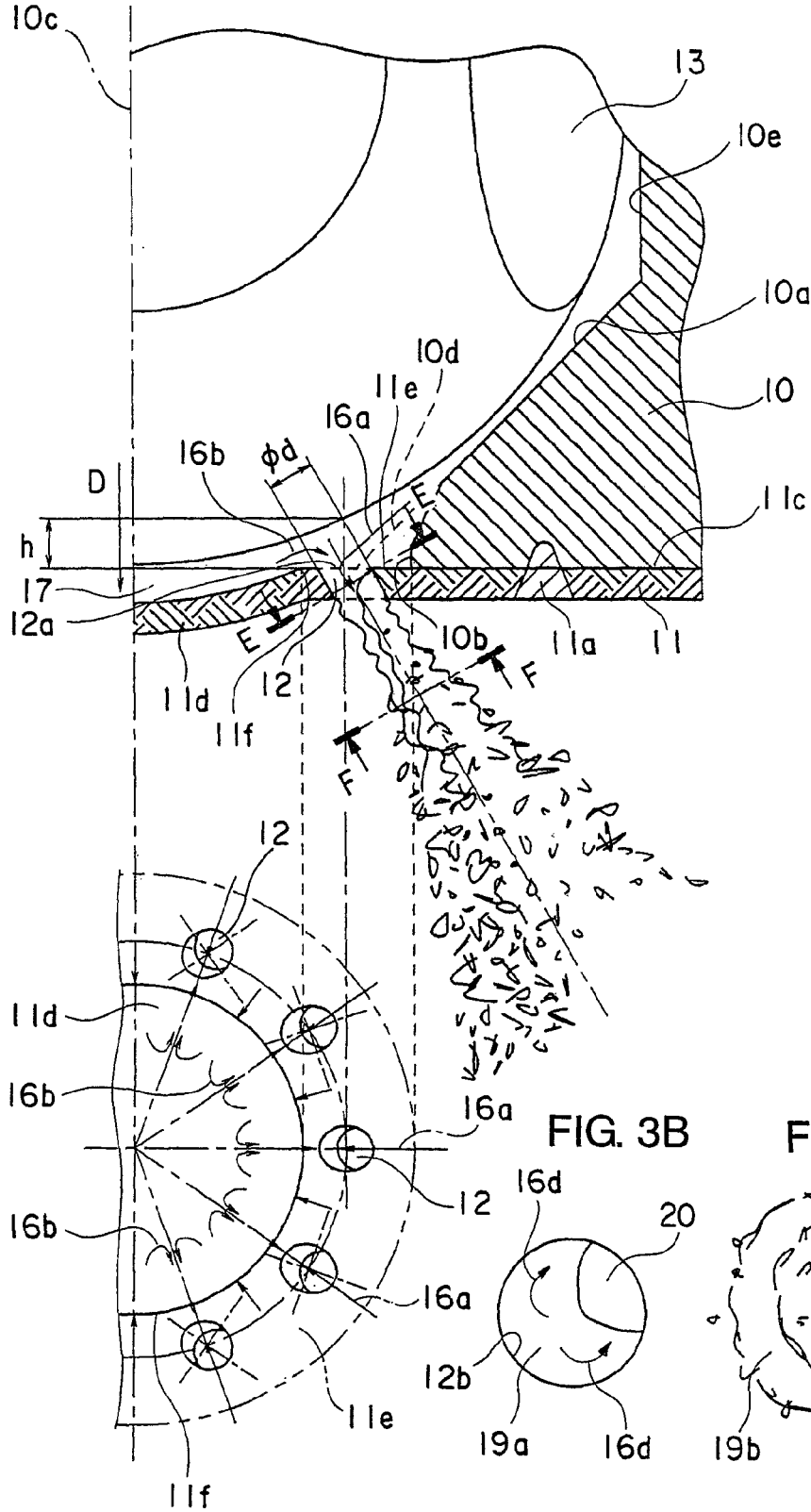
FIG. 3B
FIG. 3C
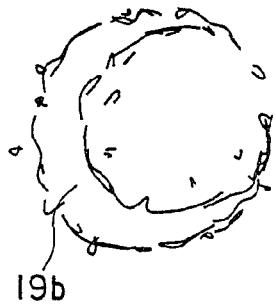
SEEN FROM ARROW D

SEEN FROM ARROW G

FUEL INJECTION VALVE

CROSS-REFERENCE TO RELATED APPLICATIONS

This application is a Divisional Application of U.S. application Ser. No. 12/093,178 filed May 9, 2008 which is a National Stage Application under 35 U.S.C. §371 of PCT/JP2007/056441 filed Mar. 27, 2007, wherein the entire disclosure of the prior applications are hereby incorporated by reference in their entirety.

The present invention relates to a fuel injection valve for use with an engine. In particular, the invention relates to a fuel injection valve having a plate with injection holes formed therethrough which is arranged at a downstream side of a valve seat and has a convex portion in a central portion thereof.

BACKGROUND OF THE INVENTION

FIG. 12 is a cross sectional view that shows essential portions of a known fuel injection valve.

In this known fuel injection valve, a ball 13 at a tip end of a valve element is moved apart from a valve seat 10, whereby fuel is injected from a plurality of injection holes 12A in an injection hole plate 11A bonded to a lower end face of the valve seat 10 into an intake pipe of an engine.

This injection hole plate 11A is formed at its central portion with a convex portion 11*d* of a circular-arc shaped cross section which is substantially axisymmetric with respect to a valve seat axis 10*c*, and which protrudes to a downstream side, and the plurality of injection holes 12A are formed through the convex portion 11*d* (see, for example, first and second patent documents, Japanese patent application laid-open No. 2001-27169 and Japanese patent application laid-open No. 2006-207419

In this fuel injection valve, the plurality of injection holes 12A are formed through the convex portion 11*d* of the injection hole plate 11A, so when the injection hole plate 11A is welded to the valve seat 10 at a welded portion 11*a*, the welded portion 11*a* shrinks upon getting cold to solidify. As a result, in those portions of the injection hole plate 11A which lie at an inner diameter side of the welded portion 11*a*, the convex portion 11*d* is pulled in a radial direction (in a direction of an arrow X) in which the height of the convex portion 11*d* becomes smaller, so a residual stress occurring in the valve seat 10 after welding is alleviated. Thus, the reduction in roundness of the cone-shaped valve seat portion 10*a* due to the welding of the injection hole plate 11A is decreased in comparison with the case where the injection hole plate 11A does not have the convex portion 11*d*, thereby providing an advantageous effect that the deterioration in oil tightness of the valve is suppressed.

In such a fuel injection valve, however, the injection holes 12A are arranged in the convex portion 11*d*, so the direction of fuel injection is changed by an injection angle θ in a direction of an arrow Y due to the deformation of the convex portion 11*d* after welding. Besides, there has been a problem that the direction of injection of the injection holes 12A is varied by the variation of welding.

SUMMARY OF THE INVENTION

The present invention is intended to obviate the problems as referred to above, and has for its object to obtain a fuel injection valve in which the direction of fuel injection is not changed even with deformation of a convex portion after welding of an injection hole plate to a valve seat, and in which there is no variation due to welding variation, thereby making it possible to suppress the deterioration in oil tightness of the valve after welding.

According to a fuel injection valve of one aspect of the present invention, in the fuel injection valve which has a valve body for opening and closing a valve seat, and receives an operation signal from a control unit to operate said valve body, so that fuel is injected from a plurality of injection holes formed in an injection hole plate welded through a welded portion to a downstream side of said valve seat while passing through a gap between said valve body and said valve seat, said injection hole plate is formed at its central portion with a convex portion which has a circular-arc shaped cross section and which is substantially axisymmetric with respect to a valve seat axis; said welded portion is substantially axisymmetric with respect to said valve seat axis; inlet portions of said injection holes are disposed in an injection hole arrangement surface diametrically outside of said convex portion and diametrically inside of a valve seat opening inner wall which is a minimum inside diameter of said valve seat; and said injection hole arrangement surface is coplanar with a surface having said welded portion.

According to a fuel injection valve of another aspect of the present invention, in the fuel injection valve which has a valve body for opening and closing a valve seat, and receives an operation signal from a control unit to operate said valve body, so that fuel is injected from a plurality of injection holes formed in an injection hole plate to a downstream side of said valve seat while passing through a gap between said valve body and said valve seat, said injection hole plate has a convex portion protruding to a downstream side substantially in parallel to a tip end portion of said valve body; an extension of a valve seat portion of said valve seat crosses said injection hole plate diametrically outside of said convex portion; inlet portions of said injection holes are disposed at locations diametrically outside of said convex portion and diametrically inside of a valve seat opening inner wall which is a minimum inside diameter of said valve seat; and an overhead height h of each of said injection holes, represented by a distance of the tip end portion of said valve body from the center of each of said inlet portions of said injection holes in a direction of a valve seat axis, and an inlet diameter d of each of said injection holes have a relation of $h \leqq 1.5\ d$ in a valve opened state.

According to a fuel injection valve of the present invention, the direction of fuel injection is not changed even if a convex portion is deformed after an injection hole plate is welded to a valve seat, and there is also no variation in the direction of fuel injection due to welding variation, so it is possible to suppress the deterioration of fluid or oil tightness of the valve after welding.

BRIEF DESCRIPTION OF THE DRAWINGS

FIG. 3A shows a cross section of essential portions of a fuel injection valve according to a second embodiment of the present invention, and a view of an injection hole plate as seen along an arrow D.

FIG. 3B is an enlarged cross sectional arrow view along line E-E in FIG. 3A.

FIG. 3C is an enlarged cross sectional arrow view along line F-F in FIG. 3A.

FIG. 13B is an enlarged cross sectional arrow view along line B-B in FIG. 13A.

FIG. 13C is an enlarged cross sectional arrow view along line C-C in FIG. 13A.

DETAILED DESCRIPTION OF THE INVENTION

Figure 1:
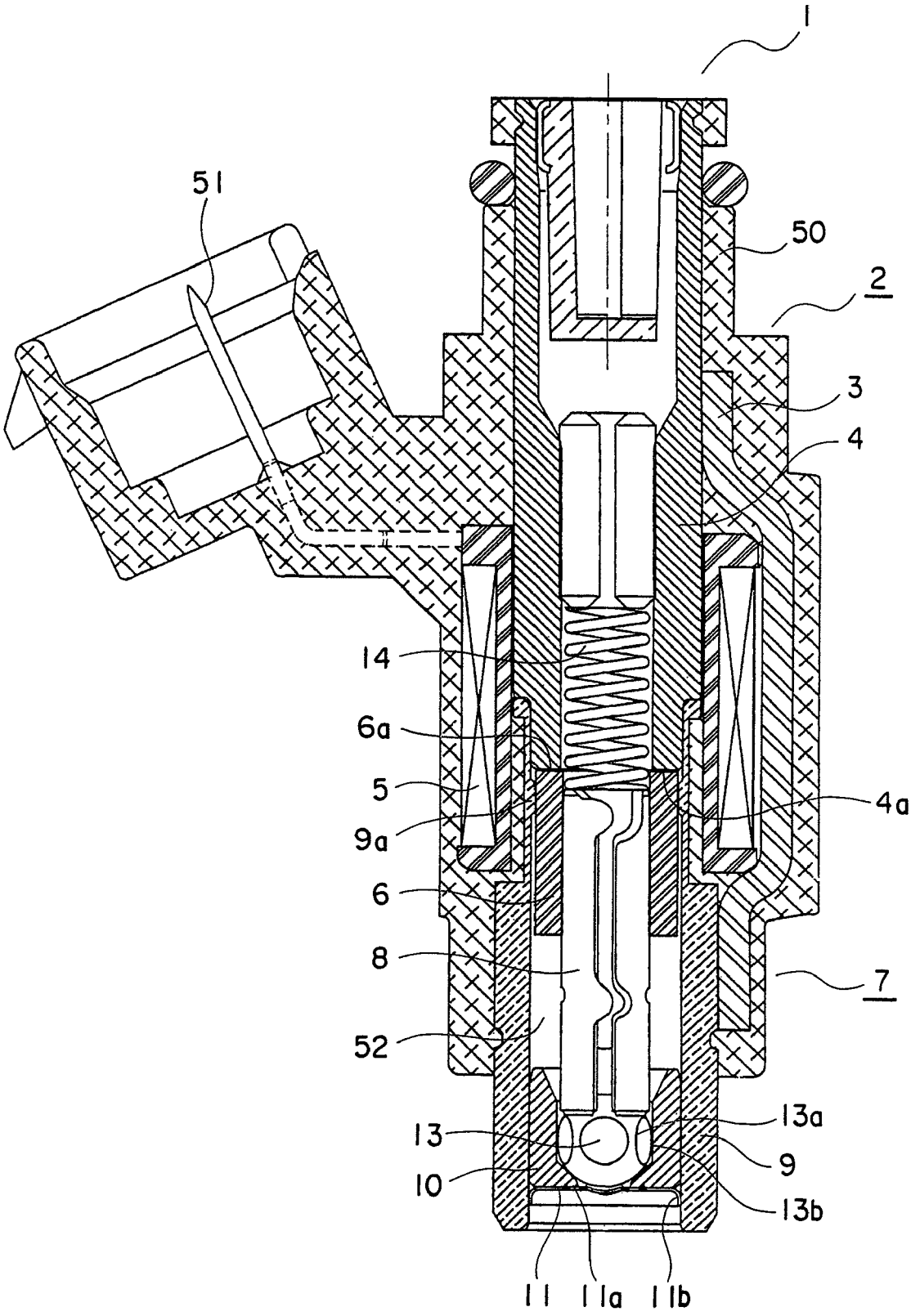
FIG. 1 is a cross sectional view showing a fuel injection value according to a first embodiment of the present invention.

Now, preferred embodiments of the present invention will be described in detail while referring to the accompanying drawings. Throughout respective figures, the same or corresponding members or parts are identified by the same reference numerals and characters.

Figure 2:
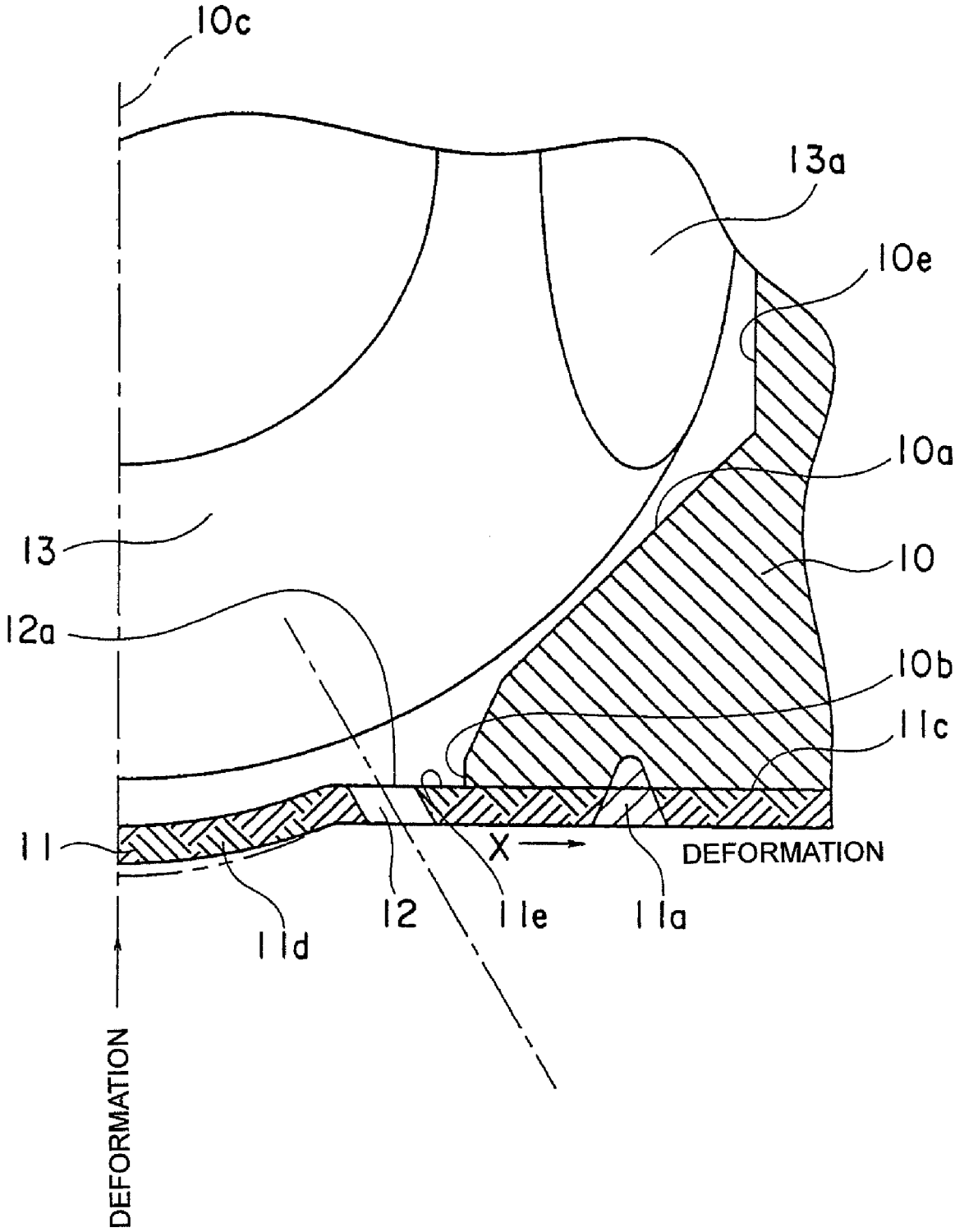
FIG. 2 is an enlarged view of a tip end portion of the fuel injection valve of FIG. 1.

FIG. 1 is a cross sectional view that shows a fuel injection valve 1 according to a first embodiment of the present invention. FIG. 2 is an enlarged view of a tip end portion of the fuel injection valve of FIG. 1.

This fuel injection valve 1 is provided with a solenoid device 2, a valve device 7 that is operated by the driving of the solenoid device 2, and a casing 50 that covers the solenoid device 2 and the valve device 7.

The solenoid device 2 includes a housing 3 that is a yoke portion of a magnetic circuit, a core 4 of a cylindrical shape that is arranged at an inner side of this housing 3, a coil 5 that surrounds this core 4, an armature 6 of a cylindrical shape that is arranged at a downstream side of the core 4 so as to be movable toward and away from a lower end face 4*a* of the core 4, a compression spring 14 that is received in the core 4, and a connector 51 that is electrically connected to the coil 5, and has its tip end portion exposed to the outside.

The valve device 7 includes a valve body 8 of a cylindrical shape that has a ball 13 at its tip end portion, a valve main body 9 of a cylindrical shape that is press-fitted into and welded to a lower outer peripheral side surface of the core 4, a valve seat 10 that is press-fitted to a lower end portion of this valve main body 9, and an injection hole plate 11 that is face-bonded to a downstream side end face of this valve seat 10 at a welded portion 11*a* by means of welding. The valve seat 10 integrally bonded to the injection hole plate 11 through the welded portion 11*a* is coupled by welding to the valve main body 9 at a welded portion 11*b* of a bent outer peripheral portion of the injection hole plate 11 after being press-fitted into the valve main body 9 from a downstream end portion thereof.

The injection hole plate 11 has a plurality of injection holes 12 formed therethrough in a thicknesswise direction and arranged at intervals along a circumferential direction.

This injection hole plate 11 is formed at its central portion with a convex portion 11*d* of a circular-arc shaped cross section which is substantially axisymmetric with respect to a valve seat axis 10*c*, as shown in FIG. 2. Also, the valve seat 10 and the welded portion 11*a* of the injection hole plate 11 are substantially axisymmetric with respect to the valve seat axis 10*c*, and an inlet portion 12*a* of each injection hole 12 is disposed at a location diametrically outside of the convex portion 11*d* and diametrically inside of a valve seat opening inner wall 10*b* which is a minimum inside diameter. An injection hole arrangement surface 11*e* is arranged coplanar with an upstream upper surface 11*c* of the injection hole plate 11 having the welded portion 11*a*.

In this connection, note that in this first embodiment, the convex portion 11*d* protrudes in a downstream direction but may instead protrude toward in an upstream direction. In addition, the injection hole arrangement surface 11*e* and the upstream upper surface 11*c* of the injection hole plate 11 are flat surfaces, but they may be circular conical surfaces.

Next, reference will be made to the operation of the fuel injection valve 1 as constructed above.

When an operation signal is sent from a control unit of an engine to a drive circuit of the fuel injection valve, current is supplied to the coil 5 through the connector 51, whereby magnetic flux is generated in a magnetic circuit that is composed of the armature 6, the core 4, the housing 3 and the valve main body 9. As a result, the armature 6 is operated to be attracted toward the core 4 against the resilient force of the compression spring 14, whereby an upper end face 6*a* of the armature 6 is caused to abut against a lower end face 4*a* of the core 4, and the valve body 8 formed integral with the armature 6 is moved away from the cone-shaped valve seat portion 10*a* to form a gap or clearance therebetween.

Simultaneously with the formation of this gap, fuel in a fuel passage 52 is injected from the injection holes 12 to an engine intake pipe (not shown) while passing through a chamfered portion 13*a* of the ball 13 arranged at the tip end portion of the valve body 8 and the above-mentioned gap.

Subsequently, when an operation stop signal is sent from the engine control unit to the drive circuit of the fuel injection valve 1, the current from the connector 51 to the coil 5 is stopped, whereby the magnetic flux in the magnetic circuit is decreased and hence the gap between valve body 8 and the valve seat portion 10*a* is placed into a closed state under the action of the resilient force of the compression spring 14 that operates to push the valve body 8 in a valve closing direction, as a result of which the injection of fuel is terminated.

Here, note that when the valve body 8 is operated to open and close, the valve body 8 slides with respect to a guide portion 9*a* that protrudes in a direction toward a diametrically inner side of the valve main body 9, and a guide portion 13*b* of the ball 13 of the valve body 8 slides with respect to a valve seat sliding portion 10*e*. The guide portion 13*b* is a part for restricting diametrical non-coaxiality (vibration) of the valve body 8 with respect to the valve seat sliding portion 10*e*. Accordingly, it is preferable to set the clearance as small as possible, and a clearance of 10 μm or less (i.e., a clearance of 5 μm or less at one side) is preferred so as to adjust the durability wear of the valve body 8 within an allowable limit.

According to the fuel injection valve of this embodiment, as can be seen from FIG. 2, each injection hole 12 is disposed at a location diametrically outside of the convex portion 11*d* and diametrically inside of the valve seat opening inner wall 10*b*, and the injection hole arrangement surface 11*e* is coplanar with the upper surface 11*c* having the welded portion 11*a*. Accordingly, even if the convex portion 11*d* is deformed due to the shrinkage of the welded portion 11*a* when it gets cold to solidify at the time of welding the injection hole plate 11 to the valve seat 10, the direction of fuel injection will not be changed, and hence there will be no variation in the direction of injection due to welding variation, thus suppressing the deterioration of the oil tightness of the valve after welding.

In addition, the welding may be carried out with the central axis of the injection hole plate 11 and the valve seat axis 10*c* of the valve seat 10 being not in coincidence with each other due to assembly variation during production. In this case, unevenness is generated in post-welding radial (direction of an arrow X) tensile stress with respect to the injection hole plate 11, and hence the stress to be alleviated by deformation of the convex portion 11*d* becomes uneven in the radial direction, too, as a result of which there is a fear that an effect of alleviating roundness reduction of the valve seat portion 10*a* might not be obtained to a sufficient extend.

In contrast to this, according to the fuel injection valve 1 of this first embodiment, the convex portion 11*d* has a circular-arc cross section, so it is possible to suppress the influence of a positional shift or deviation of the injection hole plate 11 with respect to the valve seat 10 to a smaller level than that obtained by a circular-cone or cylindrical shaped convex portion.

Further, in a fuel injection valve as described in Japanese patent application laid-open No. 2002-4983 (a third patent document), a radially extending fuel passage and injection hole inlet portions are arranged at a downstream side of a convex portion formed in the center of an injection hole plate. In this case, when there occurs a positional shift or deviation of the injection hole plate, the flow of fuel is made uneven due to a shift or deviation between a central axis of the convex portion and a valve seat axis, thus posing the problem of variation of the flow rate and the fuel spray.

In contrast to this, in the fuel injection valve of this first embodiment, the injection hole inlet portions 12*a* are disposed at a diametrically inner side from the valve seat opening inner wall 10*b*, so the convex portion 11*d* is located downstream of the inlet portions 12*a* of the injection holes 12 in the flow of fuel from the valve seat portion 10*a*. As a result, the influence of a positional shift of the injection hole plate 11 exerted on the flow rate and the fuel spray in this embodiment is smaller than that in the structure disclosed by the above-mentioned third patent document.

FIG. 3A shows a cross section of essential portions of a fuel injection valve 1 according to a second embodiment of the present invention, and a view of an injection hole plate as seen along an arrow D.

In the fuel injection valve 1 of this second embodiment, a circular-arc shaped convex portion 11*d* protruding toward a downstream side of an injection hole plate 11 is substantially parallel to a curved surface of a ball 13 that is a valve body tip end portion, and a sheet surface extension 10*d* of a valve seat portion 10*a* crosses an injection hole arrangement surface 11*e* having injection holes 12 formed thereon diametrically outside of the convex portion 11*d*. Also, the injection holes 12 have inlet portions 12*a*, respectively, disposed diametrically outside of the convex portion 11*d* and diametrically inside of a valve seat opening inner wall 10*b*. The relation between an injection hole overhead height h, represented by a distance between the center of the inlet portion 12*a* of each injection hole 12 and the direction of the valve seat axis 10*c* of the ball 13, and an inlet diameter d of each injection hole 12 is a relation of $h \leqq 1.5\ d$ in a valve opened state.

The other construction of this third embodiment is similar to that of the first embodiment.

Figure 12:
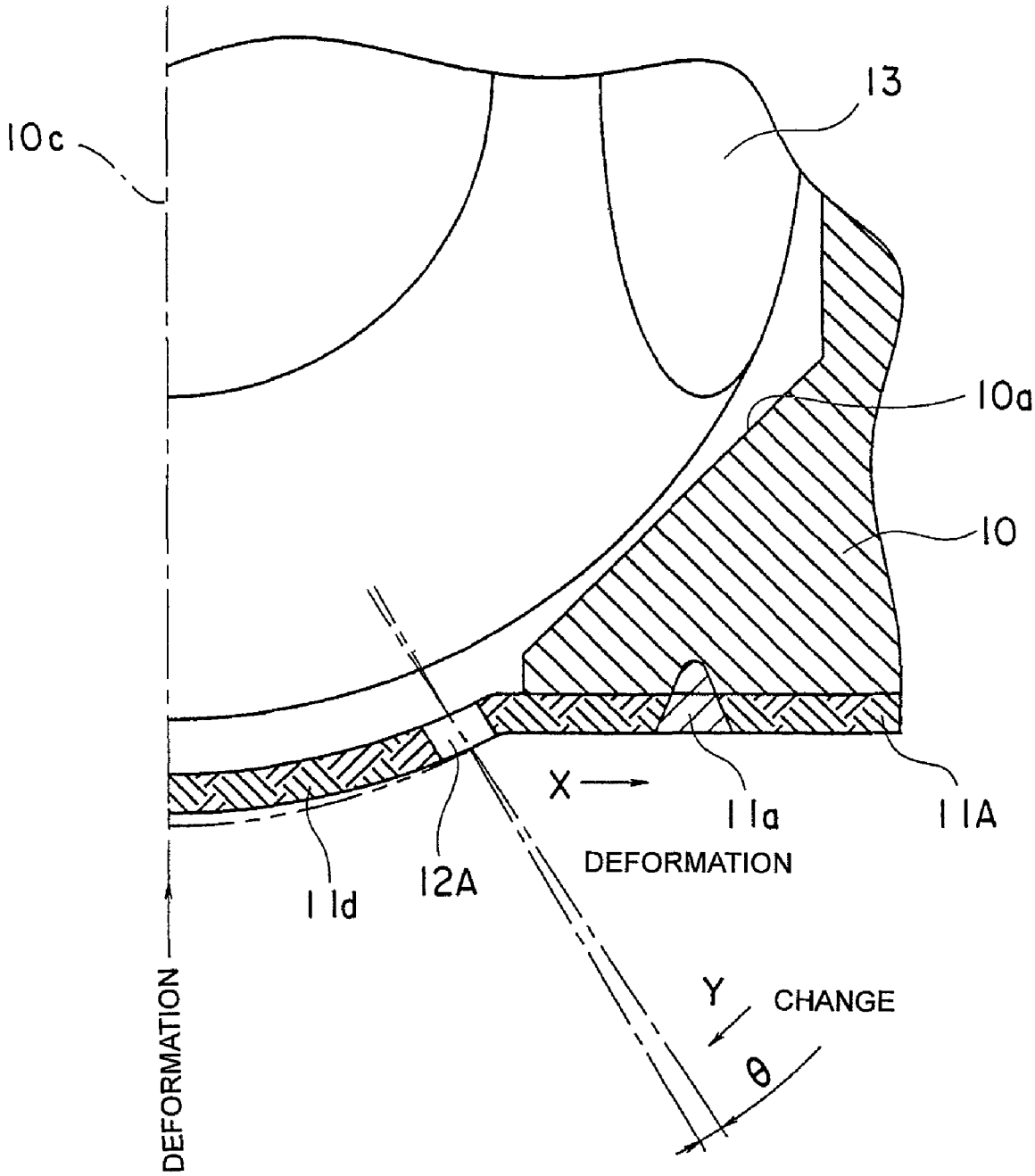
FIG. 12 is a cross sectional view showing essential portions of a known fuel injection valve.
Figure 13A:
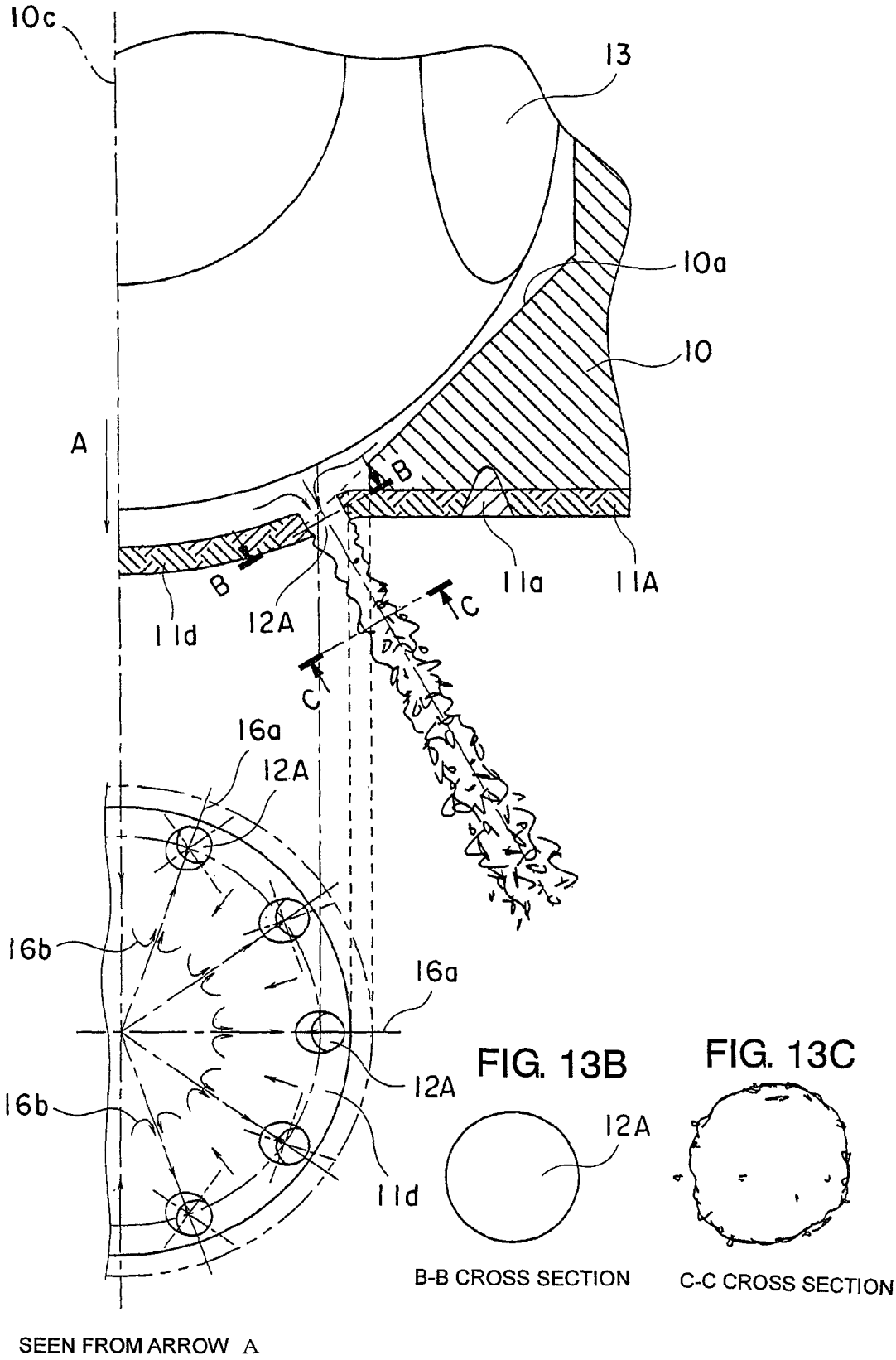
FIG. 13A shows a cross section of essential portions of the fuel injection valve in FIG. 12, and a view of an injection hole plate as seen along an arrow A.

In the fuel injection valve as described in the aforementioned second patent document and shown in FIG. 12, the injection holes 12A are disposed in a circular fashion in such a manner that so that a main stream 16*a* of fuel having passed the valve seat portion 10*a* impinges or collides directly against inner wall surfaces of the injection holes 12A, respectively, at a convex portion 11*d* side, as shown in FIG. 13A.

In the case of the fuel injection valve, fuel having passed between adjacent injection holes 12A collides with the fuel having flowed in opposition thereto in the center of the injection hole plate 11A, whereby it is made into a U turn flow 16*b* with its direction of flow being changed into a flow directed to the injection holes 12A, but it is important how to deal with this radial U-turn flow 16*b*.

In the fuel injection valve as described in this second patent document, the injection holes 12A are arranged in the convex portion 11*d* that protrudes toward a downstream side substantially in parallel to the ball 13, and the distance between the injection hole plate 11A and the ball 13 which are passed by fuel is uniformly narrower from the upstream up to the injection holes 12A in comparison with that in the one of the second embodiment. Accordingly, the above-mentioned U-turn flow 16*b* and the main stream 16*a* flowing directly toward the injection holes 12A collide head-on with each other at the inlet portions 12*a* of the injection holes 12A, so the direct collision of the main stream 16*a* against the inner wall surfaces of the injection holes 12A as intended by the above-mentioned second patent document occurs only immediately after the opening of the valve, but the main stream 16*a* does not collide with the inner wall surfaces of the injection holes 12A in a steady state period in which the valve is in a fully opened state, so a spray of fuel becomes streaks, and a satisfactory atomization effect as shown in FIGS. 13B and 13C can not be obtained.

In contrast to this, in the fuel injection valve of the second embodiment, the sheet surface extension 10*d* crosses the injection hole arrangement surface 11*e* diametrically outside of the convex portion 11*d*, as shown in FIG. 3A, so the main stream 16*a* of fuel flowing along the sheet surface extension 10*d* lands on the injection hole arrangement surface 11*e*. Further, a cavity height in the form of a distance from the upstream upper surface 11*c* of the injection hole plate 11 to a hole 13 in the direction of the valve seat axis 10*c* is substantially constant from the center of the injection hole plate 11 up to a diametrically outermost portion 11*f* of the convex portion 11*d*, but increases in a region of the injection hole arrangement surface 11*e* from the diametrically outermost portion 11*f* of the convex portion to the valve seat opening inner wall 10*b*.

Thus, the main stream 16*a* of fuel upon opening of the valve can get under the U-turn flow 16*b* thrown out from the diametrically outermost portion 11*f* along the contour of the convex portion 11*d*, so the head-on collision of the fuel main stream 16*a* and the U-turn flow 16*b* with each other can be avoided, and the reduction in the flow speed of the fuel main stream 16*a* due to the U-turn flow 16*b* can be suppressed.

Figure 4:
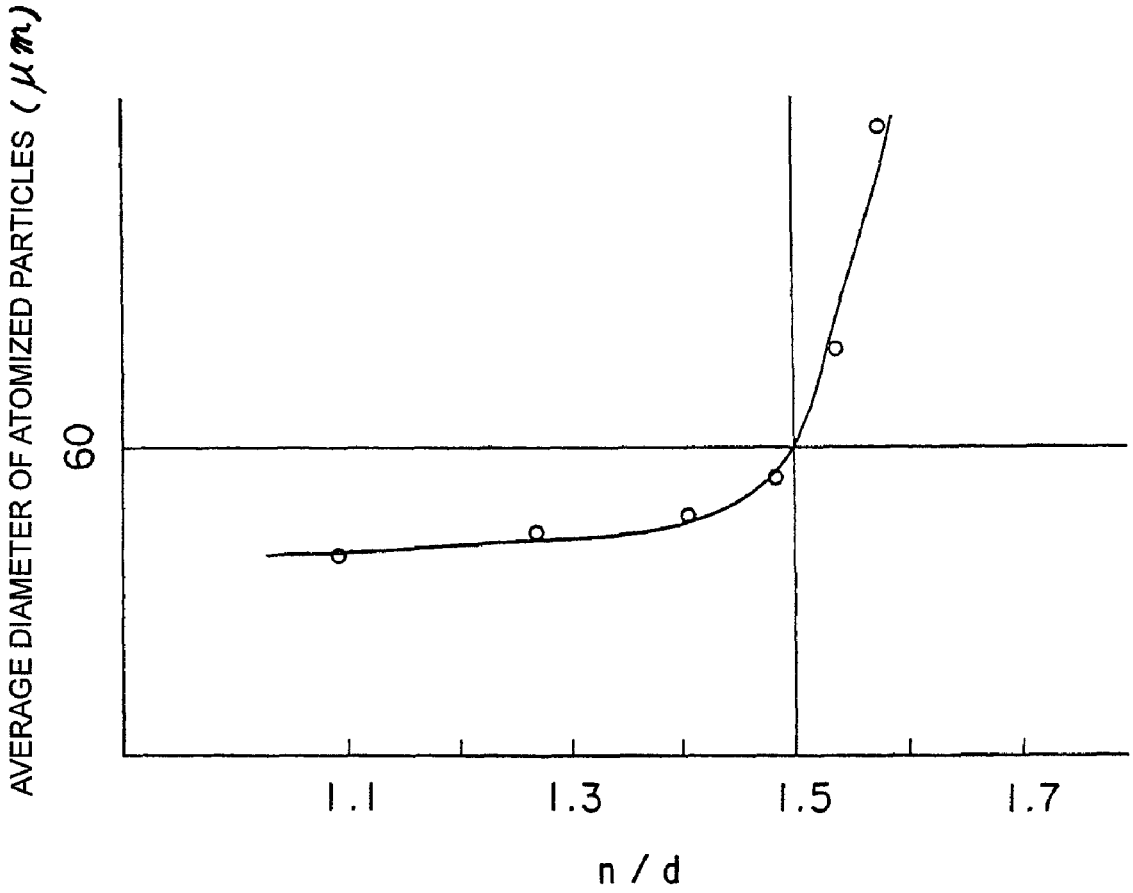
FIG. 4 is a characteristic view showing the relation between (h/d) and the average diameter of sprayed or atomized particles in a fuel injection valve of FIG. 3A.

The inventor of this application obtained the relation among the injection hole overhead height h, the injection hole inlet diameter d, and the average diameter of sprayed or atomized particles through experiments. FIG. 4 is a view that shows the results of the experiments at that time.

From this view, it is found that in a valve opened state, the average diameter of sprayed or atomized particles becomes remarkably large in case of (h/d)>1, whereas small atomized particle sizes or diameters are obtained in a stable manner in case of (h/d)≦1.5.

When this relation holds, the head-on collision of the main stream 16*a* of fuel and the U-turn flow 16*b* is avoided, and the fuel main stream 16*a* of which the flow speed reduction due to the collision is suppressed collides with the injection hole wall 12*b* at the inlet portions 12*a* of the injection holes 12 while keeping its fast flow speed, whereby the direction of flow thereof is suddenly changed.

Accordingly, as shown in FIG. 3B, a liquid film 19*a* is formed due to the peeling off of the flow at the inlet portion 12*a* of each injection hole 12, and fuel is pushed to each injection hole wall 12*b* whereby the flow in each injection hole 12 is made into a flow 16*d* along the curvature of the injection hole 12, thus facilitating the mixing of the fuel with air 20 in the injection hole 12. Then, as shown in FIG. 3C, the fuel is diffused from an outlet of the injection hole 12 as a crescent-shaped liquid film 19*b*, thereby facilitating atomization of the fuel.

In addition, upon injection of fuel into a negative pressure atmosphere, a part of the fuel in a cavity 17 enclosed by the valve body 8, the valve seat 10 and the injection hole plate 11 after closing of the valve has been completed is sucked out from the injection holes 12 into the engine intake pipe under the action of the negative pressure. In this case, in a fuel injection valve as described in the specification of Japanese Patent No, 31831556 (a fourth patent document), a main stream directly going to injection holes through a gap or clearance between a valve body and a valve seat and a radial U-turn flow that passes through between adjacent injection holes and is U-turned by a counter flow in the center of injection hole plate are caused to collide with each other in a uniform manner, whereby fuel is intended to be atomized due to disturbance thereof.

Thus, the flow speed of a cavity fuel in each injection hole sucked out after closing of a valve has been completed under a negative pressure is small, so there is a fear that a spray of fuel with poor particle size might be injected immediately after completion of the valve closing, or fuel might not be able to leave the injection holes, inducing the adhesion of fuel to an end face of the injection hole plate around outlets of the injection holes.

In addition, in the fuel injection valve as described in the above-mentioned fourth patent document, the U-turn flow in the radial direction is strong, so a spray of fuel with poor particle size is injected outside of an intended direction of injection, or the fuel adhered to the injection hole plate end faces around the injection hole outlets without being able to leave the injection holes is blown off at the following injection, thus causing a splashing phenomenon in which a poor spray of fuel is injected outside of the intended direction of injection.

Accordingly, the adhesion of fuel to the wall of an intake port is increased and the fuel flows into a combustion chamber as liquid films, whereby the deterioration of exhaust gas and the deterioration of the controllability of engine power might be caused.

In contrast to this, in the fuel injection valve of the second embodiment, disturbances in the flow to the injection holes 12 are suppressed by suppressing the head-on collision of the U-turn flow 16*b* and the main stream 16*a* of fuel, so the flow speed in the injection holes 12 of the fuel in the cavity 17 sucked out after completion of the valve closing under negative pressure is large, thereby suppressing a splashing phenomenon.

In addition, since the convex portion 11*d* protruding substantially in parallel to the ball 13 in a downstream direction thereof is formed on the injection hole plate 11, it is advantageous in reducing the volume of the cavity 17 enclosed by the valve body 8, the valve seat 10 and the injection hole plate 11 while avoiding interference between the valve body 8 and the injection hole plate 11. Accordingly, the rising speed of the increasing fuel pressure in the cavity can be raised immediately after opening of the valve, and an excellent atomization characteristic can be obtained even immediately after the valve opening.

Moreover, there is also another advantage that positioning accuracy of the injection holes 12 at the time of processing the injection holes 12 is higher and variation in the flow rate and the fuel spray is smaller when the injection holes are arranged in a flat surface diametrically outside of the convex portion 11*d* than when the injection holes 12 are arranged in the convex portion 11*d* of the injection hole plate 11.

Figure 5:
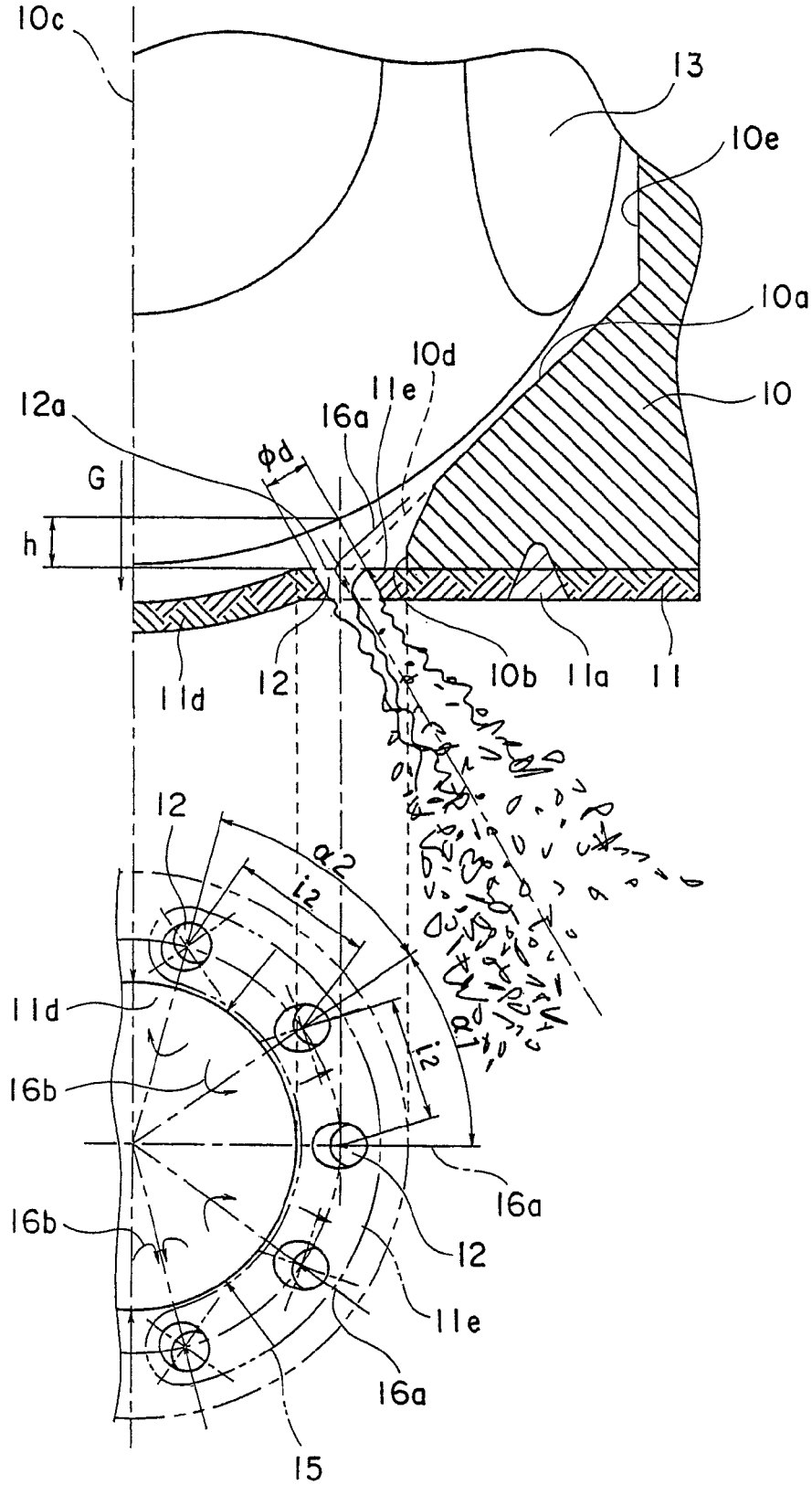
FIG. 5 shows a cross section of essential portions of a fuel injection valve according to a third embodiment of the present invention, and a view of an injection hole plate as seen along an arrow G.

FIG. 5 shows a cross section of essential portions of a fuel injection valve 1 according to a third embodiment of the present invention, and a view of an injection hole plate 11 as seen along an arrow G.

In the fuel injection valve 1 of this third embodiment, injection holes 12 are disposed on the same circle having a valve seat axis 10*c* as its center, and there are two injection hole groups 15 in each of which sprays of fuel injected from a plurality of injection holes 12 form one set spray, and two set sprays are injected in mutually different directions, respectively.

When it is assumed that distances between the centers of the inlet portions 12*a* of adjacent injection holes 12 among the injection holes groups 15 are i1, i2, respectively, or that corresponding pitch angles are $\alpha 1$, $\alpha 2$, respectively, the injection holes 12 are disposed so as to satisfy a relation of $i1<i2$ or $\alpha 1<\alpha 2$.

The construction of this third embodiment other than the above is similar to that of the second embodiment.

In this third embodiment, when distances between the centers of the inlet portions 12*a* of adjacent injection holes 12 are set i1, i2, respectively, or when corresponding pitch angles are represented by $\alpha 1$, $\alpha 2$, respectively, the injection holes 12 are disposed so as to satisfy the relation of $i1<i2$ or $\alpha 1<\alpha 2$. As a result, there occurs variation in strength of those portions of fuel which pass between adjacent injection holes 12, so U-turn flows 16*b* flow mainly into shorter regions between adjacent injection holes 12 and are prevented from flowing into the injection holes 12 where they are in opposition to the main stream 16*a* of fuel.

Accordingly, the reduction in the flow speed of the main stream 16*a* of fuel due to the U-turn flows 16*b* is suppressed, and in addition, there exists a relation of h≦1.5 d in the valve opened state, so the fuel main stream 16*a* is suddenly changed in the direction of flow thereof at the inlet portions 12*a* of the injection holes 12 while keeping a fast flow speed. As a result, the fuel flow peels off at the inlet portions 12*a* of the injection holes 12 to facilitate the atomization of fuel.

In addition, in this third embodiment, the injection holes 12 are disposed so as to provide the relation of i1<i2 or $\alpha$1<$\alpha$2, so the interference between the fuel sprays injected from the individual injection holes 12 can be suppressed.

Although in this third embodiment, the fuel injection valve 1 having two injection hole groups 15 has been described herein, the invention may be applied to a fuel injection valve having three or more injection hole groups in which fuel is injected in individually different directions.

Figure 6A:
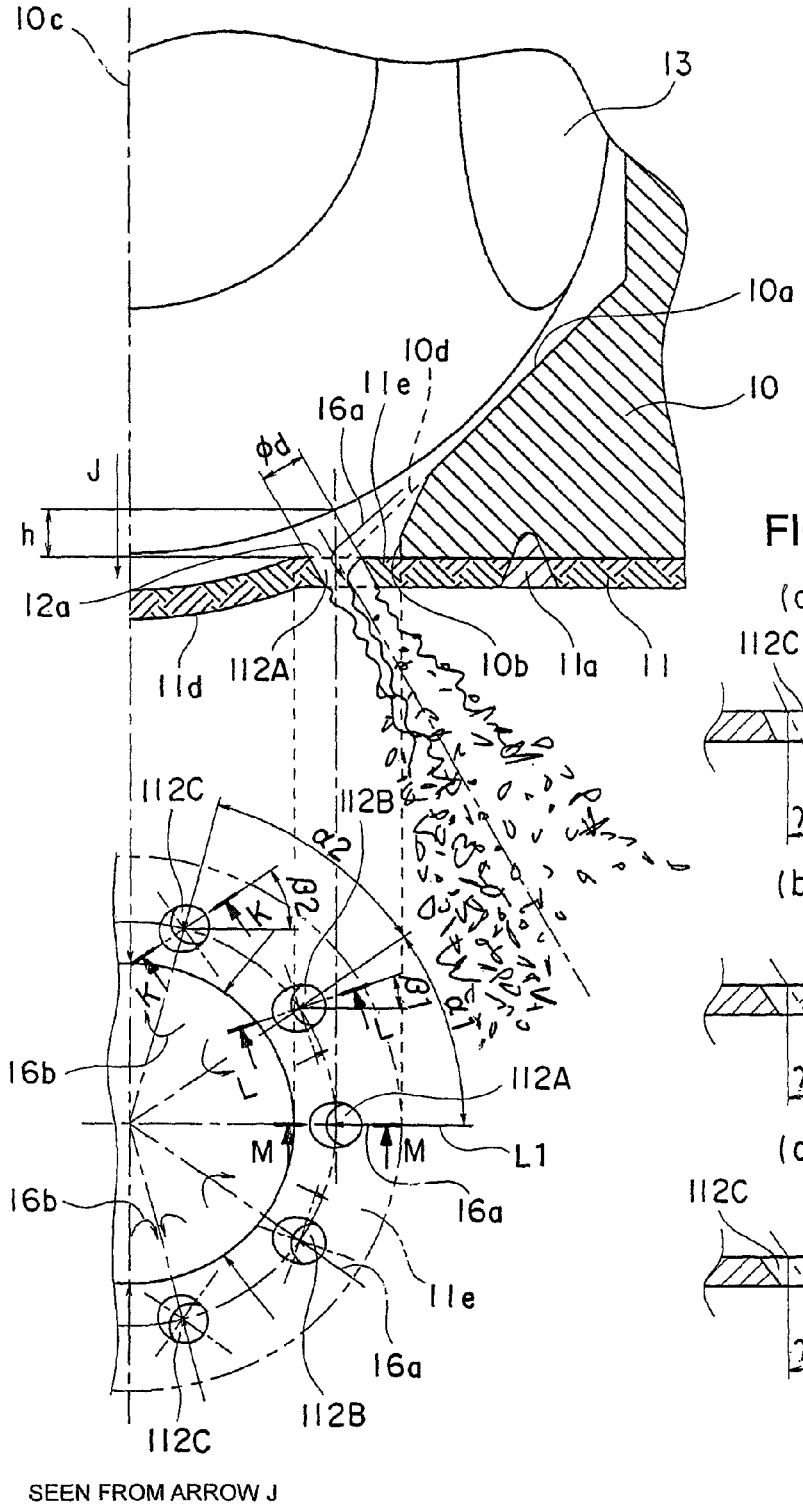
FIG. 6A shows a cross section of essential portions of a fuel injection valve according to a fourth embodiment of the present invention, and a view of an injection hole plate as seen along an arrow J.
Figure 6B:
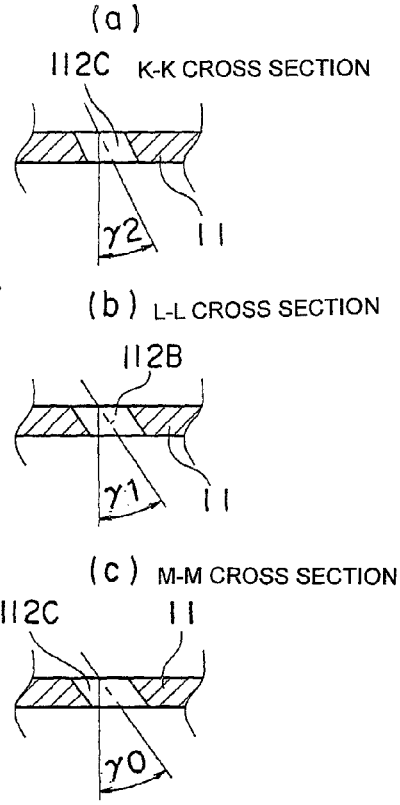
FIG. 6B(a) is a cross sectional arrow view along line K-K in FIG. 6A, FIG. 6B(b) is a cross sectional arrow view along line L-L in FIG. 6A, and FIG. 6B(c) is a cross sectional arrow view along line M-M in FIG. 6A.

FIG. 6A shows a cross section of essential portions of a fuel injection valve 1 according to a fourth embodiment of the present invention, and a view of an injection hole plate 11 as seen along an arrow J. FIG. 6B(a) is a cross sectional arrow view along line K-K in FIG. 6A. FIG. 6B(b) is a cross sectional arrow view along line L-L in FIG. 6A. FIG. 6B(c) is a cross sectional arrow view along line M-M in FIG. 6A.

In this fourth embodiment, the injection holes 112A, 112B, 112C are disposed in an injection hole arrangement surface 11*e* of the injection hole plate 11 in such a manner that when pitch angles are represented by $\alpha$1, $\alpha$2, their relation becomes $\alpha$1<$\alpha$2. In addition, these individual injection holes 112A, 112B, 112C are formed in such a manner that their directions of injection of fuel differ from one another.

That is, the individual injection holes 112A, 112B, 112C are formed in such a manner that injection hole outside angles ($\beta$1, $\beta$2), when angles, at which the central axes of the individual injection holes 112A, 112B, 112C cross parallel lines which are in parallel to a reference line L1 connecting between a valve seat axis 10*c* and the center of an inlet portion of a reference injection hole 112A and pass the centers of inlet portions of the injection holes 112B, 112C, respectively, are seen along the valve seat axis 10*c*, are larger for the injection hole 112B than for the injection hole 112A, and are larger for the injection hole 112C than for the injection hole 112B.

In addition, the individual injection holes 112A, 112B, 112C are also formed in such a manner that injection hole angles ($\gamma$ 0, $\gamma$ 1, $\gamma$ 2), at which the central axes of the individual injection holes 112A, 112B, 112C cross the vertical lines which are in parallel to the valve seat axis 10*c* and pass the centers of the inlet portions of the injection holes 112A, 112B, 112C, respectively, are larger for the injection hole 112B than for the injection hole 112C, and in addition are larger for the injection hole 112A than for the injection hole 112B.

The construction of this fourth embodiment other than the above is similar to that of the second embodiment.

According to the fuel injection valve of this fourth embodiment, the individual injection holes 112A, 112B, 112C are different from one another with respect to the injection hole outside angle ($\beta$1, $\beta$2) and the injection hole angles ($\gamma$ 0, $\gamma$ 1, $\gamma$ 2), so interference among the fuel sprays injected from the individual injection holes 112A, 112B, 112C is suppressed.

Figure 7:
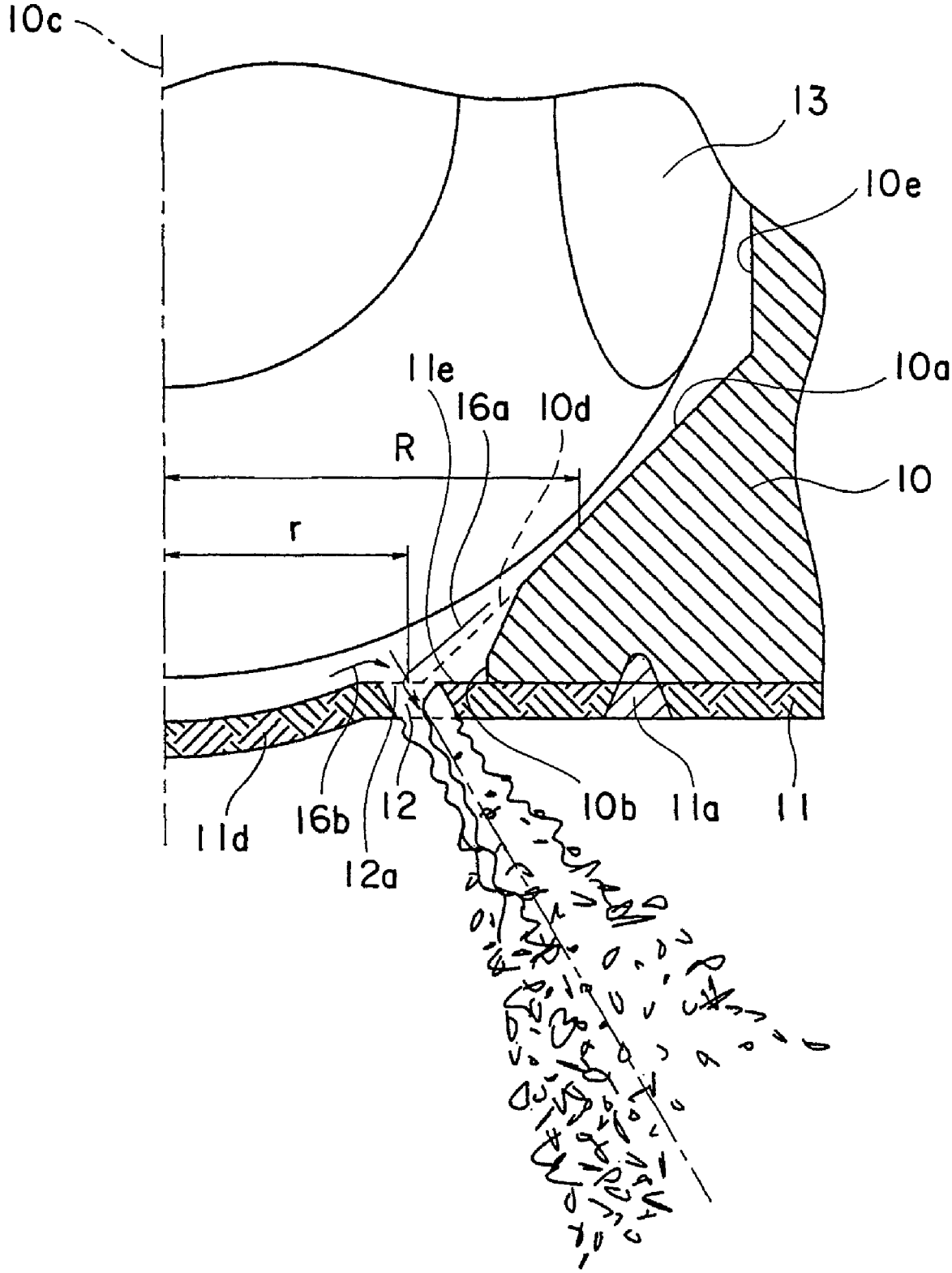
FIG. 7 is a cross sectional view showing essential portions of a fuel injection valve according to a fifth embodiment of the present invention.

FIG. 7 is a cross sectional view that shows essential portions of a fuel injection valve 1 according to a fifth embodiment of the present invention.

In the fuel injection valve 1 of this fifth embodiment, when it is assumed that at the time of closing of the valve, a seat radius with which a ball 13 of a valve body 8 is seated on a valve seat portion 10*a* of a valve seat 10, and that a distance from a valve seat axis 10*c* to the center of an inlet portion 12*a* of each injection hole 12 is r, the relation between the seat radius R and the distance r is $0.5 \leqq r/R \leqq 0.8$.

The construction of this fifth embodiment other than the above is similar to that of the second embodiment.

In the fuel injection valve as described in the above-mentioned fourth patent document, the injection holes are disposed in opposition to a flat portion formed on the valve body at its tip end, and hence is remote from the valve sheet portion with a channel arrangement having a large pressure loss, as a result of which there is the following problem. That is, not only any satisfactory atomization effect can not be obtained in a stable region of a fully open valve state, but also the rising speed of the fuel pressure in the inlet portions of the injection holes immediately after the valve opening is slow, and the level of particle size immediately after the valve opening is bad.

In contrast to this, in the fuel injection valve 1 of this fifth embodiment, a channel arrangement from a gap or clearance between the valve body 8 and the valve seat 10 to the inlet portions 12*a* of the injection holes 12 is substantially a straight line and hence is small in pressure loss. Further, there exist a relation of $h \leqq 1.5\ d$ and a relation of $0.5 \leqq r/R \leqq 0.8$.

Accordingly, distances from the valve seat portion 10*a* to the inlet portions 12*a* of the injection holes 12 are small, so fuel reaches the inlet portions 12*a* of the injection holes 12 swiftly at the start of the valve opening, and the main stream 16*a* of fuel from the valve seat portion 10*a* flows into the injection holes 12 smoothly.

Figure 8:
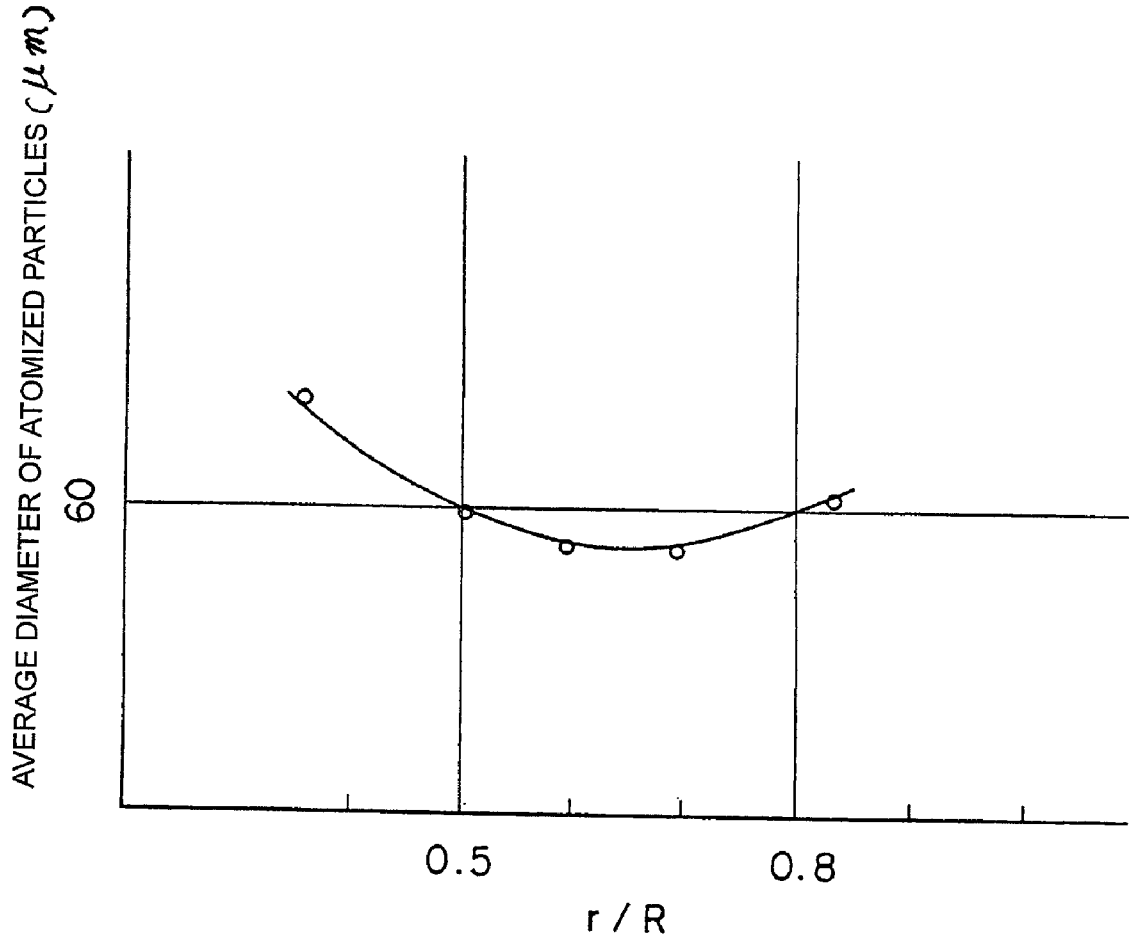
FIG. 8 is a characteristic view showing the relation between (r/R) and the average diameter of atomized particles in the fuel injection valve according to the fifth embodiment of the present invention.

FIG. 8 is a view when the inventor obtained through experiments the relation between (r/R) and the average diameter of atomized particles immediately after the valve opening. From this view, it is found that the average diameter of atomized particles is small in the range of $0.5 \leqq (r/R) \leqq 0.8$ in the relation between the seat radius R and the distance r even immediately after the valve opening.

Figure 9:
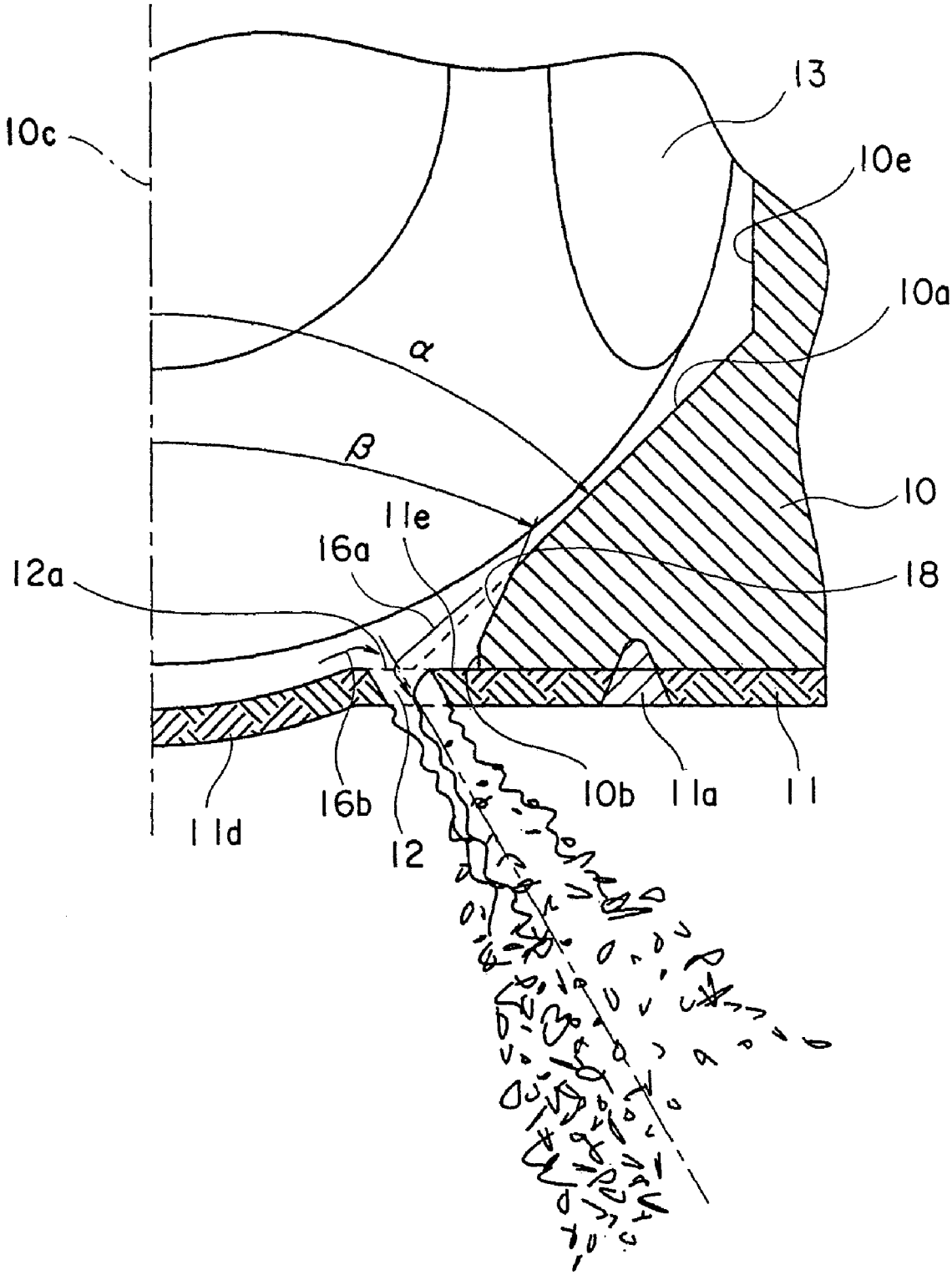
FIG. 9 is a front elevational view showing essential portions of a fuel injection valve according to a sixth embodiment of the present invention.

FIG. 9 is a front elevational view showing essential portions of a fuel injection valve 1 according to a sixth embodiment of the present invention.

In the fuel injection valve 1 of this sixth embodiment, assuming that an included angle between the valve seat portion 10*a* and the valve seat axis 10*c* is $\alpha$ and that an included angle between a tapered portion 18, which is between the valve seat portion 10*a* and the valve seat opening inner wall 10*b*, and the valve seat axis 10*c* is $\beta$, there exists a relation of $20° \leqq (\alpha-\beta) \leqq 40°$.

The construction of this sixth embodiment other than the above is similar to that of the second embodiment.

In order to eliminate the offset of spray distribution caused by a positional displacement of the injection holes 12 or a horizontal displacement between the injection hole plate 11 and the valve seat 10, it is effective to increase the distances of the inlet portions 12*a* of the injection holes 12 and the valve seat opening inner wall 10*b*.

However, if the diameter of the valve seat opening inner wall 10*b* is increased, the height of the valve seat opening inner wall 10*b* inevitably becomes higher in the valve seat portion 10*a* that has a prescribed angle of inclination or tilt, so when fuel flows from the valve seat portion 10*a* to the injection holes 12 along the valve seat opening inner wall 10*b*, the flow of fuel peels off on the way, and fluid energy is lost due to disturbance, thus causing a problem that atomization is impaired.

In the fuel injection valve 1 of this sixth embodiment, by the provision of the tapered portion 18 between the valve seat portion 10*a* and the valve seat axis 10*c*, the height of the inner wall of the valve seat opening inner wall 10*b* can be decreased even if the diameter of the valve seat opening inner wall 10*b* is made large, and there exists the relation of $20° \leqq (\alpha-\beta) \leqq 40°$. As a result, peeling off of fuel in the valve seat portion 10*a*, the tapered portion 18, and the valve seat opening inner wall 10*b* can be suppressed to a minimum.

In addition, the distances of the inlet portions 12*a* of the injection holes 12 and the valve seat opening inner wall 10*b* become large, so it is possible to eliminate the offset of spray distribution due to the positional displacement of the injection holes 12 or the horizontal displacement between the injection hole plate 11 and the valve seat 10.

Figure 10:
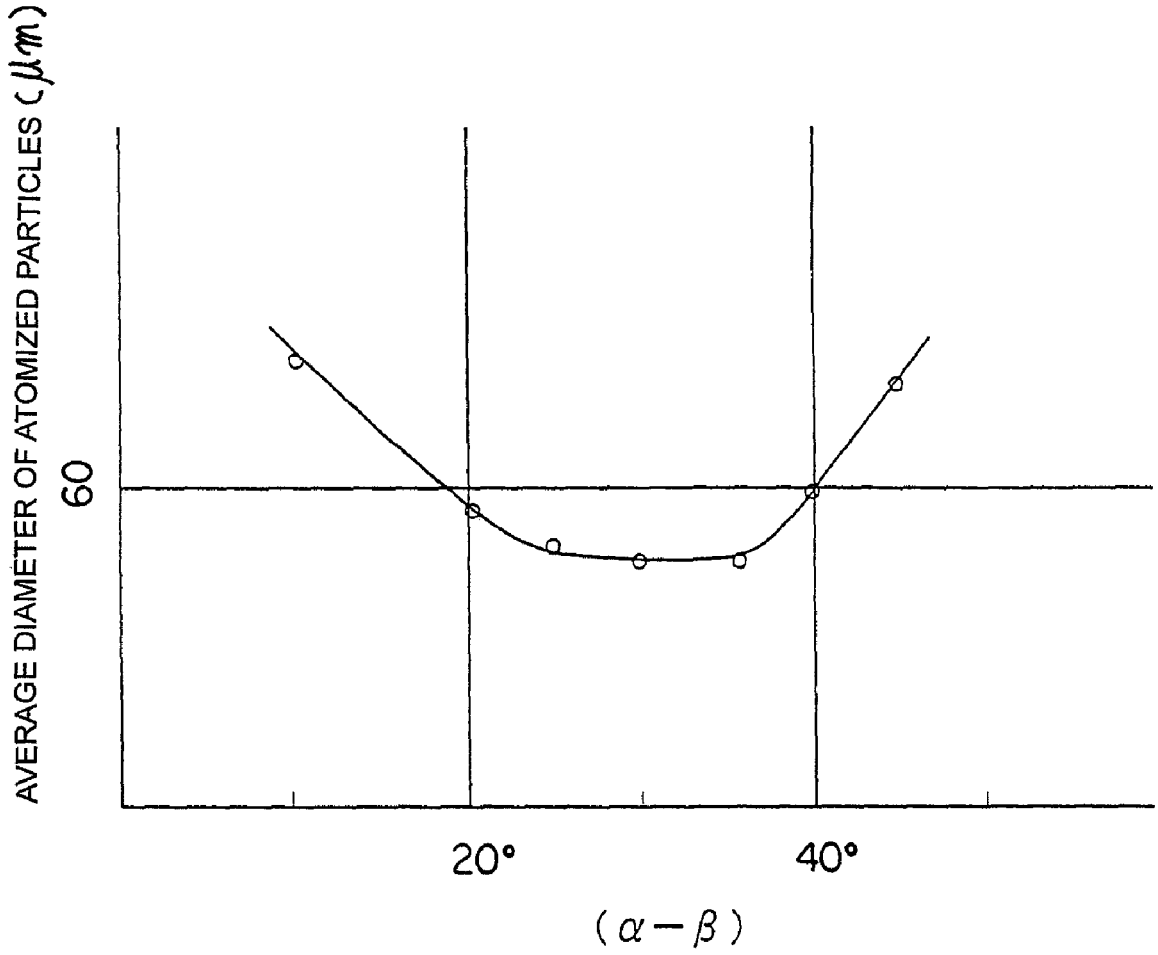
FIG. 10 is a characteristic view showing the relation between ($\alpha-\beta$) and the average diameter of atomized particles in a fuel injection valve according to the sixth embodiment of the present invention.

FIG. 10 is a view when the inventor obtained through experiments the relation between $(\alpha-\beta)$ and the average diameter of atomized particles. From this view, it is found that in case where $40°<(\alpha-\beta)$ and $20°>(\alpha-\beta)$, the fuel flow peels to a large extent at the valve seat portion 10*a*, the tapered portion 18, and the valve seat opening inner wall 10*b*, and fluid energy is lost by such disturbances, so desired atomized particle sizes can not be obtained, whereas desired atomized particle sizes can be obtained in a range of $20°<(\alpha-\beta)<40°$.

In a fuel injection valve 1 of this seventh embodiment, the volume of a cavity enclosed by a ball 13 of a valve body 8, a valve seat 10 and an injection hole plate 11 at the time of valve closing is 0.8 $mm^3$ or less.

The construction of this embodiment other than the above is similar to that of the second embodiment.

In the seventh embodiment of the present invention, a splashing phenomenon can be suppressed by reducing an amount of cavity fuel to be sucked out after the valve closing under a negative pressure is completed.

In addition, the degree of deterioration of atomized particle size that is deteriorated more under the negative pressure than under the atmospheric pressure can be reduced.

Figure 11:
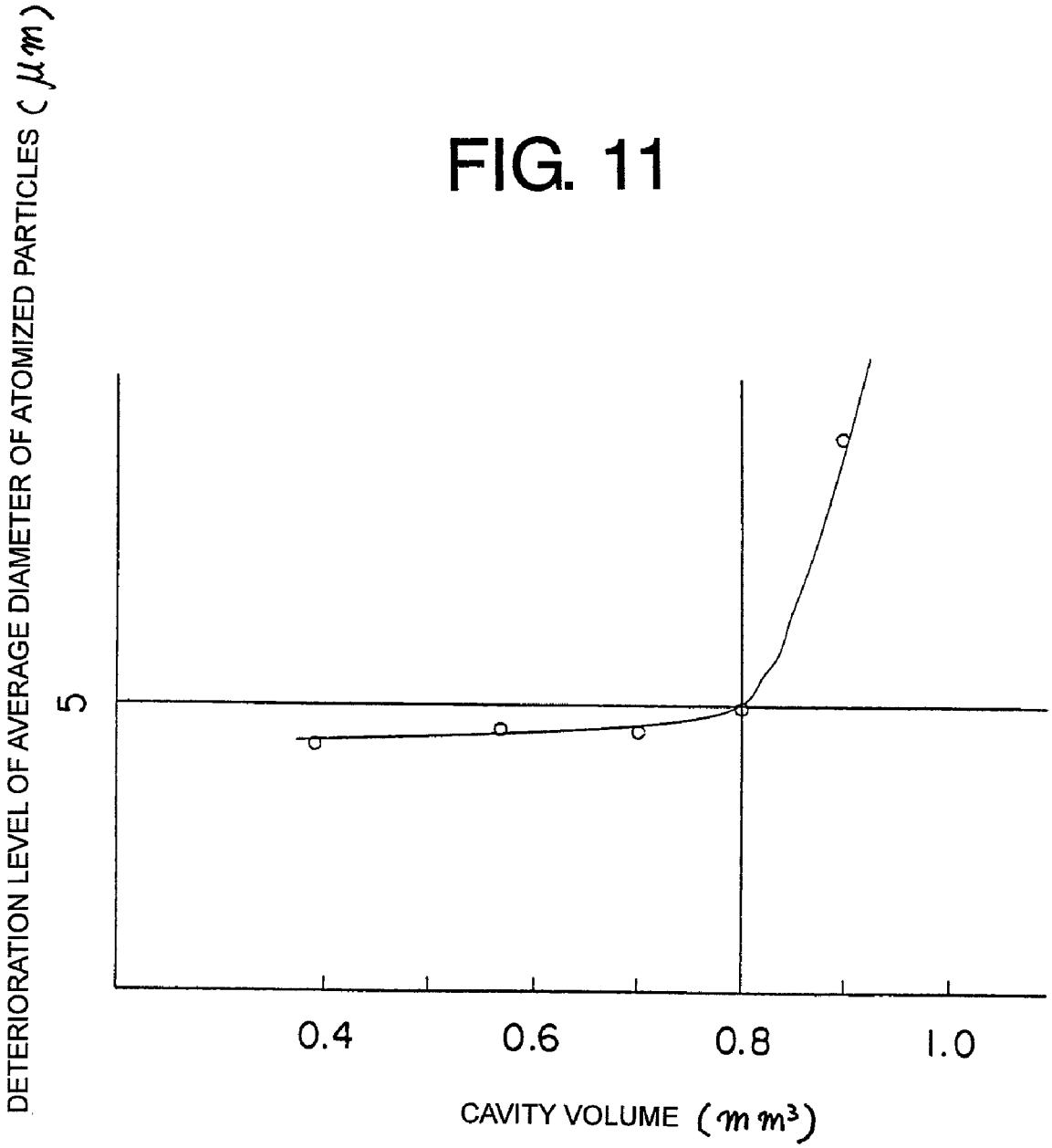
FIG. 11 is a characteristic view showing the relation between the volume of a cavity and the average diameter of atomized particles in a fuel injection valve according to a seventh embodiment of the present invention.

FIG. 11 is a view when the inventor obtained through experiments the relation between the cavity volume and the average diameter of atomized particles under a negative pressure (−500 mmHg) with respect to that under the atmospheric pressure.

From this view, it is found that the average diameter of atomized particles becomes remarkably large and is deteriorated when the cavity volume exceeds 0.8 $mm^3$, and hence excellent atomization can not be obtained, whereas stable and small atomized particle sizes can be obtained when the cavity volume is 0.8 $mm^3$ or less, and the degree of deterioration of atomized particle size is reduced.

In the above-mentioned first through seventh embodiments, explanations have been made to the fuel injection valves 1 in which the injection hole plate 11 and the valve seat 10 are formed separately from each other, but for the second through seventh embodiments, the injection hole plate and the valve seat may be formed of the same member and integrally with each other.

With the formation thereof made of the same member, the coaxiality between the convex portion and the ball of the valve body can be improved, and the offset of the fuel flow is reduced, thereby making it possible to reduce the diametrical variation of spray.

The invention claimed is:

1. A fuel injection valve which has a valve body for opening and closing a valve seat, and receives an operation signal from a control unit to operate said valve body, so that fuel is injected from a plurality of injection holes formed in an injection hole plate to a downstream side of said valve seat while passing through a gap between said valve body and said valve seat, wherein said injection hole plate has a convex portion protruding to a downstream side substantially in parallel to a tip end portion of said valve body; an extension of a valve seat portion of said valve seat crosses said injection hole plate diametrically outside of said convex portion; inlet portions of said injection holes are disposed at locations diametrically outside of said convex portion and diametrically inside of a valve seat opening inner wall which is a minimum inside diameter of said valve seat; and an overhead height h of each of said injection holes, represented by a distance of the tip end portion of said valve body from the center of each of said inlet portions of said injection holes in a direction of a valve seat axis, and an inlet diameter d of each of said injection holes has a relation of $h \leqq 1.5\ d$ in a valve opened state.

2. The fuel injection valve as set forth in claim 1, wherein said injection hole plate and said valve seat are formed integral with each other and made of the same member.

* * * * *